US005083132A

United States Patent [19]

Kanda et al.

[11] Patent Number: 5,083,132

[45] Date of Patent: Jan. 21, 1992

[54] PLANAR ANTENNA WITH ACTIVE CIRCUIT BLOCK

[75] Inventors: Minoru Kanda; Mikio Komatsu; Hidetsugu Nunoya; Yasuhiro Fujii; Toshio Abiko, all of Kadoma, Japan

[73] Assignee: Matsushita Electric Works, Ltd., Osaka, Japan

[21] Appl. No.: 516,549

[22] Filed: Apr. 30, 1990

[51] Int. Cl.[5] ..... H01Q 1/380; H01Q 13/080; H01Q 21/000; H01P 1/000

[52] U.S. Cl. ..... 343/700 MS; 333/247; 343/701; 343/853

[58] Field of Search ..... 343/700 MS, 829, 84 C, 343/853, 701; 13/080; 333/247, 250; 455/272, 275, 291, 327

[56] References Cited

U.S. PATENT DOCUMENTS 3,757,342 9/1973 Jasik et al. ..... 343/700 MS
4,771,294 9/1988 Wasilousky ..... 343/853
4,801,943 1/1989 Yabu et al. ..... 343/700 MS
4,857,938 8/1989 Tsukamoto et al. ..... 343/700 MS
4,962,383 10/1990 Tresselt ..... 343/700 MS

FOREIGN PATENT DOCUMENTS 0205881 9/1986 Japan ..... 343/700 MS
0195609 12/1986 Japan ..... 345/700 MS
2217112 10/1989 United Kingdom .

*Primary Examiner*—Michael C. Wimer
*Assistant Examiner*—Peter Toby Brown
*Attorney, Agent, or Firm*—Burns, Doane, Swecker & Mathis

[57] ABSTRACT

A planar antenna has an active circuit block, the whole or part of which is internally mounted to a planar antenna body so that connecting terminal of the block will be connected to a feeding point on power supply plate of the antenna body. Dimensional minimization of the entire antenna can be thereby attained and noise figure of the active circuit can be simultaneously reduced.

9 Claims, 10 Drawing Sheets

PLANAR ANTENNA WITH ACTIVE CIRCUIT BLOCK

BACKGROUND OF THE INVENTION

This invention relates to planar antennas.

The planar antennas of the kind referred to can be effectively utilized in fields such as satellite broadcasting reception and satellite communication.

DESCRIPTION OF RELATED ART

Generally, a reception system for satellite broadcasting comprises a planar antenna including a planar antenna body and a down-converter, a tuner and a television receiver. In this case, an attempt to elevate the ratio of signal level provided to the tuner or television receiver with respect to noise faces a requisite that antenna gain is elevated or noise figure of the down-converter is reduced.

There has been disclosed in, for example, Japanese Utility Model Application Laid-Open Publication No. 61-195609 by Jun Minase et al. a planar antenna device in which an antenna mounting plate for carrying a planar antenna on a front side is provided on a rear side, with waveguides and a converter made integral with a coupler for the waveguides, and a power supply means is formed by a first power supply terminal led from a power supply part of the planar antenna to be disposed in the waveguides and a second power supply terminal led from a power supply part of the converter into the waveguide. In this event, the generally employed connector between the planar antenna and the converter is not used so that the power supply can be attained without any connection loss hitherto occurring at the connector. With the arrangement of Minase et al, however, the waveguides and their coupler (required to be interposed between the planar antenna and the converter) have caused such problems to arise that the required number of parts has to be increased which renders the arrangement to be complicated, and the required disposition of the respective power supply terminals as extended from the planar antenna and the converter causes manufacturing and assembling to be rather troublesome. Because of the increased number of required parts, in particular, the known device has not been able to be minimized in size, and the reduction in the noise figure has not reached a sufficiently satisfactory level In B.D. Ghelar et al, U.S. patent application Ser. No. 210,433, on the other hand, there has been disclosed a planar antenna in which it was attempted to minimize size and simplify the arrangement, in which substantially the whole of the converter is accommodated in the antenna body to be remarkably contributive to the minimization of dimensions. Among local oscillators of main constituent members of the converter, a dielectric resonator and converter casing as the whole are considerably larger than the thickness of normal antenna body, and this arrangement of accommodating substantially the whole of the converter within the antenna body involves a problem in respect of realizability.

SUMMARY OF THE INVENTION

A primary object of the present invention is, therefore, to provide a planar antenna which can reduce the connection loss between the planar antenna body and the down-converter and the noise figure of the down-converter can be made to be the minimum.

Another object of the present invention is to provide a planar antenna which is simplified in arrangement and is thus excellent for manufacturing and assembling.

A still further object of the present invention is to provide a planar antenna which is minimized in the required number of parts so that the device can be of the minimum dimensions and still can reduce the noise figure to a sufficiently satisfactory level.

According to the present invention, these objects can be attained by means of a planar antenna which comprises an antenna body into which a grounding conductor plate, a feeding network plate having a feeding network pattern formed thereon, and a radiation circuit plate having a radiation circuit pattern formed thereon are assembled as mutually properly separated, an active circuit block mounted to the antenna body as at least partly incorporated therein, and means for connecting a feeding point of the feeding network plate to a connecting point of the active circuit block.

Other objects and advantages of the present invention shall become clear from following description of the invention detailed with reference to preferred embodiments of the invention.

While the present invention shall now be described with reference to the respective embodiments as shown, it should be appreciated that the intention is not to limit the present invention only to these embodiments but rather to include all alterations, modifications and equivalent arrangements possible within the scope of appended claims.

DETAILED DESCRIPTION OF THE PREFERRED EMBODIMENTS

Figure 1:
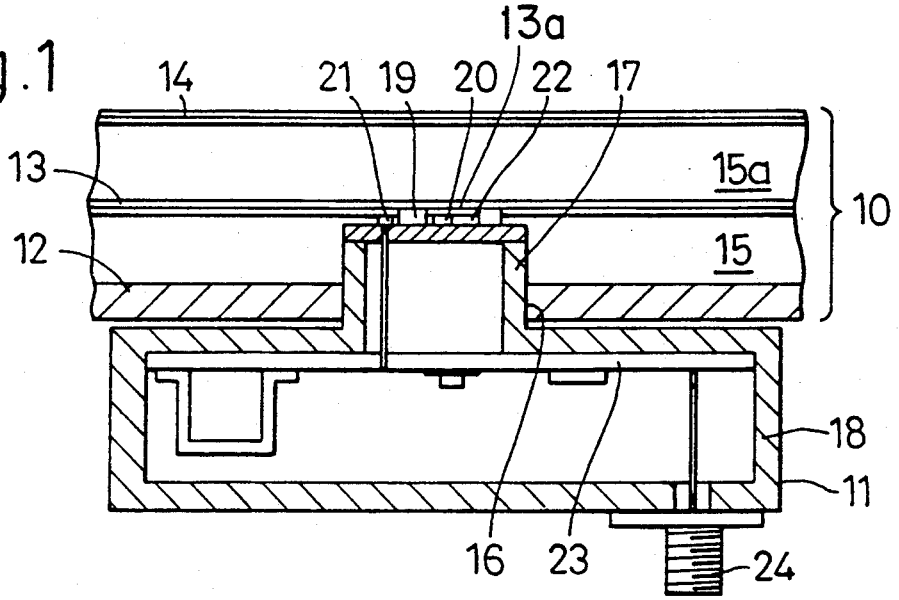
FIG. 1 is a fragmentary sectioned view of the planar antenna in an embodiment according to the present invention.
Figure 2:
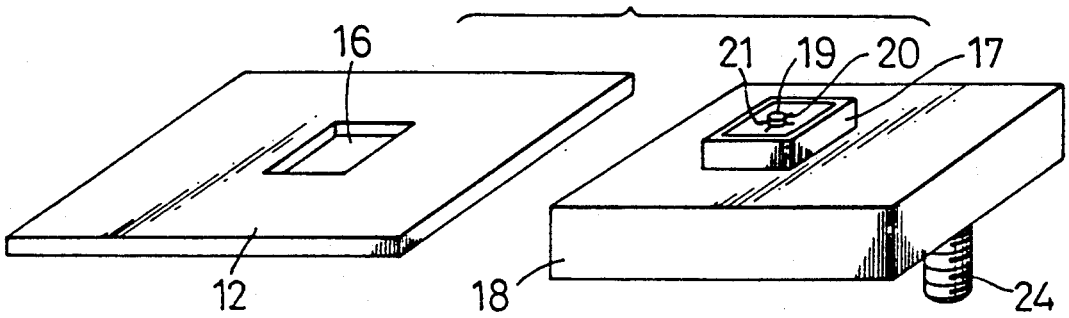
FIG. 2 is a perspective view as disassembled of a part of the planar antenna of FIG. 1.

Referring to FIGS. 1 and 2, the planar antenna according to the present invention generally comprises an antenna body 10 and a down-converter 11 which forms an active circuit block for amplifying antenna output and converting it into a low frequency, and these two constituents 10 and 11 are joined to be integral. The antenna body 10 comprises a grounding conductor plate 12, a feeding network plate 13 on which a feeding network pattern is formed, and a radiation circuit plate 14 on which a radiation circuit pattern is formed, the respective plates of which are arranged to be mutually superposed with proper spaces 15 and 15*a* iterposed between them, so as to be a suspended triple configuration-plate. On the respective circuit patterns of the feeding network plate 13 and radiation circuit plate 14, there are provided preferably insulating sheets covering the circuit patterns. In the grounding conductor plate 12, there is provided an aperture 16 at a position corresponding to a power supply terminal of the feeding network plate 13.

On the other hand, the down-converter 11 as the active circuit block, which mainly includes, for example, an amplifying device and local oscillators (not shown), comprises a conductive casing 18 including a projection 17 to be inserted into the aperture 16 of the grounding conductor plate 12, while the casing 18 is to accommodate therein, in particular, among a local oscillator, a relatively large size dielectric resonator and the like. In this case, the dielectric resonator and the like and the casing 18 accommodating therein the resonator and so on are normally considerably larger in the thickness than the antenna body 10 and, accordingly, they are required to be disposed outside but adjacent the antenna body 10. Outer projected end of the projection 17 is made to have a gate 20 led out of the projection 17 as an input terminal of an amplifying device 19 at front end so that, when the projection 17 of the down-converter 11 is inserted through the aperture 16 into the antenna body 10, the gate 20 of the amplifying device 19 can be connected to the power supplying point of the power supplying circuit plate 13. In other words, among the constituent elements of the down-converter 11, such amplifying device and other electronic circuit elements than the dielectric resonator that are relatively thin enough for being easily accommodatable within the antenna body 10, are separated from the casing 18 and are disposed inside the antenna body 10. This arrangement contributes to the simplification of the arrangement and the dimensional minimization. In this case, the gate 20 of the amplifying device 19, to be brought into contact with the feeding point of the feeding network plate 13; is connected by means of soldering to a conductor 13*a* exposed by peeling off the insulating sheet of the circuit plate at a position corresponding to the feeding point of the circuit plate 13. It may be also possible, without peeling off the insulating sheet, to have the gate 20 opposed to the conductor 13*a* at the feeding point with an insulating substrate of the circuit plate 13 so that the gate 20 and feeding point can be coupled by means of electrostatic induction. Further, the outer end of the projection 17 is so arranged that a negative biasing voltage is applied to the gate 20 of the amplifying device 19 while a positive biasing voltage is applied to a drain 21, and these biasing voltages are so set that the amplifying device 19 will act at a value of low noise figure. Further, since an input impedance at a point where the amplifying device 19 which comprises a GaAsFET is actuated with the noise figure NF made the lowest is made close, for example, to about (20+j20) the impedance at the power supplying point of the feeding network plate 13, the feeding network pattern is so designed that the impedance at the power supplying point will be preliminarily set to be the foregoing input impedance (an impedance conversion pattern is formed as occasion demands). The amplifying device 19 is incorporated in an auxiliary printed substrate 22, and an output of the amplifying device 19 is provided, through a main printed substrate 23 in which a mixing circuit, intermediate frequency amplifier and so on are incorporated, to an output part 24 of the down-converter 11.

Now, in the present embodiment, the connection between the gate 20 forming the signal input terminal of the antenna output amplifying device 19, of a low noise and the feeding point of the feeding network plate 13, is realized without any connector, the connection loss can be reduced in contrast to any known arrangement using the connector and, in addition, the amplifying device 19 which is a low noise amplifier can be made actuatable in the state where its noise figure NF is minimum. It should be appreciated here that sufficiently high reception properties can be maintained even when a reception zone formed by the feeding network plate 13 and radiation circuit plate 14 is made smaller for the dimensional minimization of the planar antenna.

Figure 3:
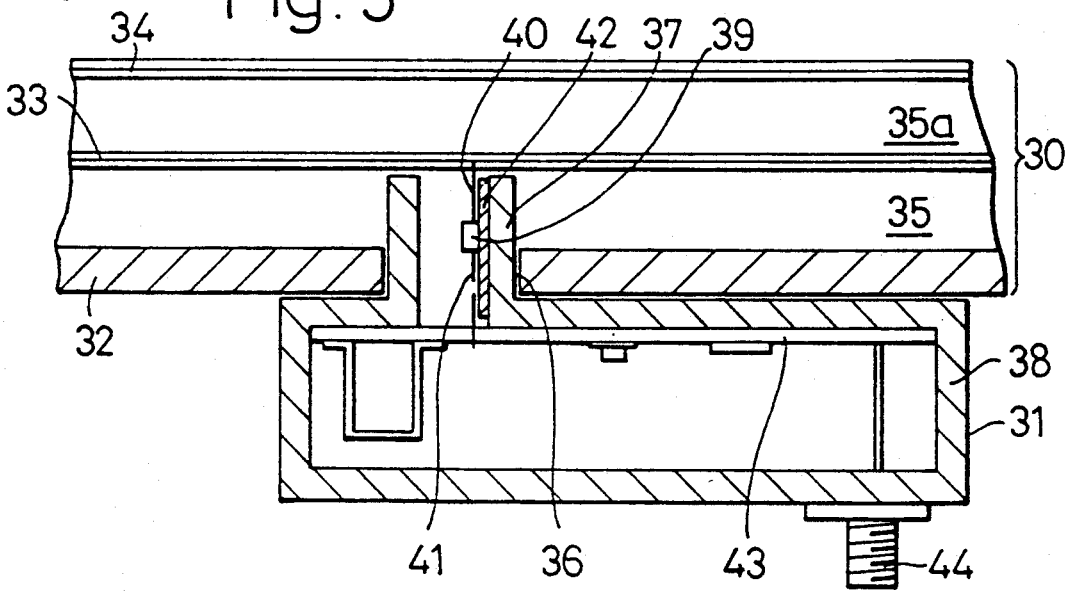
FIG. 3 is a fragmentary sectioned view, as magnified, of the planar antenna in another embodiment according to the present invention.
Figure 4:
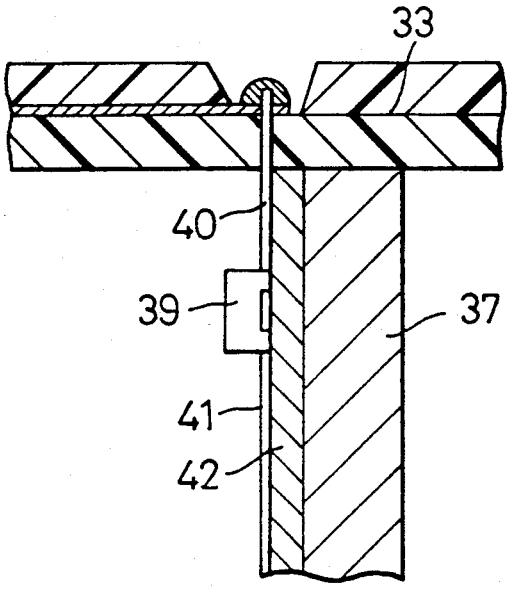
FIG. 4 shows in sectioned view, as further magnified, a part of the planar antenna of FIG. 3.

In FIGS. 3 and 4, there is shown another embodiment according to the present invention, in which top end of a projection 37 of a casing 38 is opened while an auxiliary printed substrate 42 carrying an amplifying device 39 is secured to an inner wall face of the projection 37. A gate 40 of the amplifying device 39 is passed through the insulating sheet, via through hole in feeding network plate 33 to the feeding point of the feeding network pattern and soldered thereto. Other constituent elements and their functions are identical to those in the embodiment of FIGS. 1 and 2, and the same constituent elements as those in the embodiment of FIGS. 1 and 2 are denoted by the same reference numerals but as added by 20.

Figure 5:
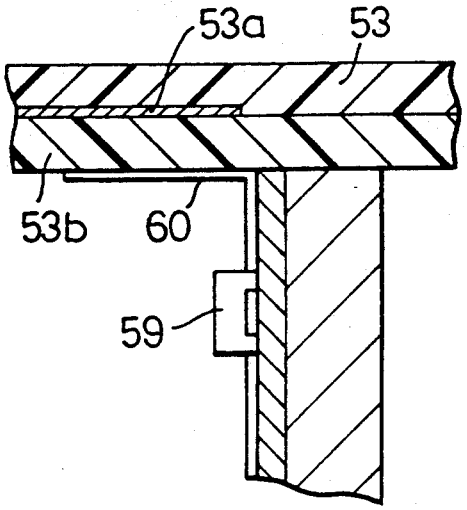
FIG. 5 shows the same part as in FIG. 4 but in another working aspect according to the present invention.

In another aspect of the present invention as shown in FIG. 5, a gate 60 of amplifying device 59 is not soldered directly to feeding point 53*a* of feeding network plate 53, but is disposed to extend in parallel to the conductor strip of the feeding point 53*a* with insulating sheet 53*b* of the feeding network plate 53 interposed between them so that they will be mutually coupled by means of electrostatic induction. In this case, too, other constituent elements and their functions are the same as those in the foregoing embodiment of FIGS. 1 and 2.

Figure 7:
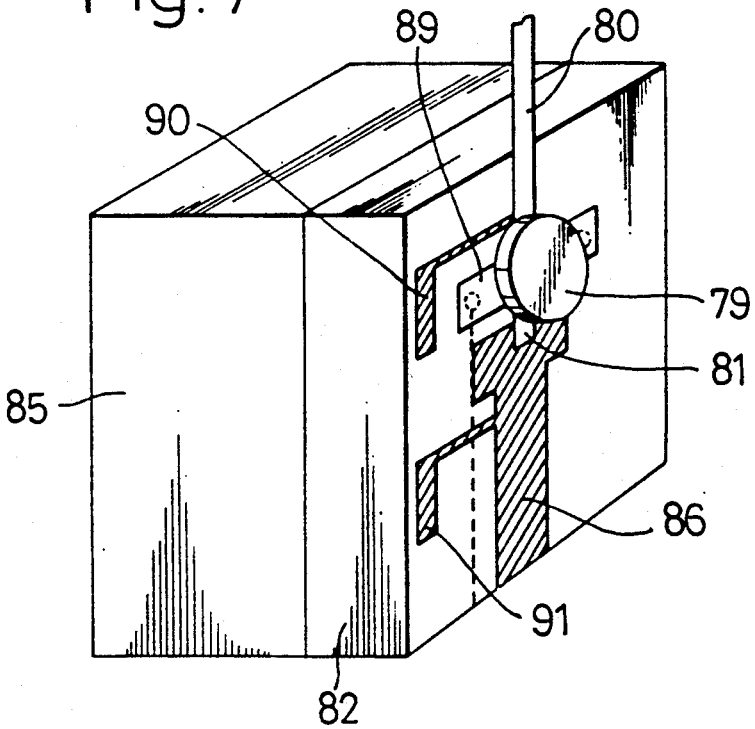
FIG. 7 is a perspective view, as further magnified, of a part of the planar antenna of FIG. 6.
Figure 6:
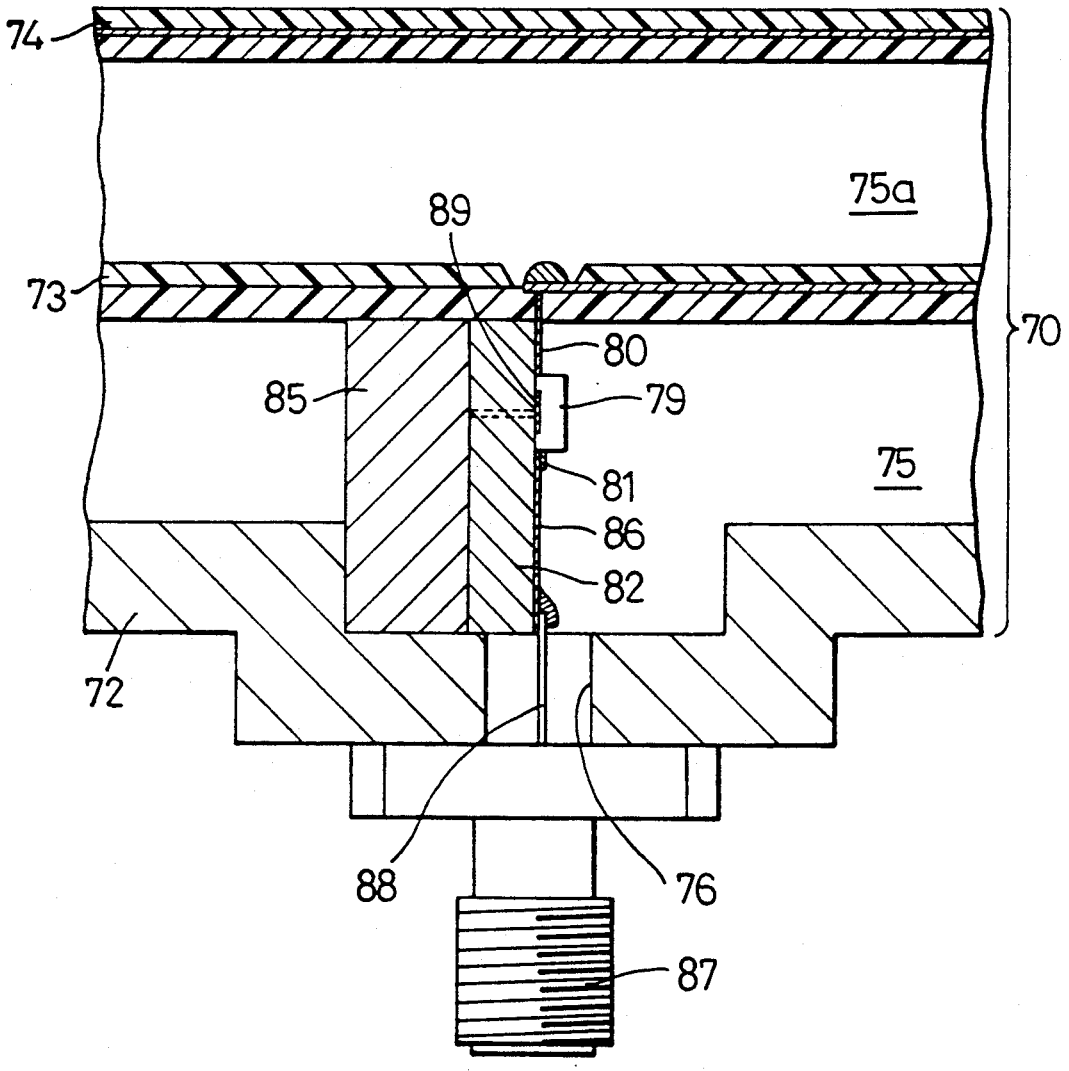
FIG. 6 is a fragmentary sectioned view, as magnified, of the planar antenna in still another embodiment according to the present invention.

In FIGS. 6 and 7, there is shown still another embodiment of the present invention, in which a feeding point of feeding network plate 73 and a gate 80 of amplifying device 79 mounted to auxiliary printed substrate 82 are mutually connected substantially in the same manner as in the foregoing embodiment of FIGS. 3 and 4. In the present instance, however, the auxiliary printed substrate 82 is supported by an auxiliary grounding conductor 85 as a spacer between grounding conductor plate 72 and feeding network plate 73, and an output line 86 of the amplifying device 79 is connected as soldered to a core wire 88 of a connector 87, which core wire 88 is provided to extend through an aperture 76 formed in the grounding conductor plate 72 into antenna body 70, while the connector 87 itself is made connectable in any known manner to the down-converter (not shown in FIGS. 6 and 7) to be employed as the active circuit block. Further, it is preferable that a source 89 of the amplifying device 79 is connected to the auxiliary grounding conductor 85, while a negative biasing voltage is applied through a gate bias feed line 90 to the gate 80 and a positive biasing voltage is applied through a drain bias feed line 91 (though these members are not referred to in the foregoing embodiments, they are employable concurrently). With the present embodiment, too, the connection loss can be remarkably reduced and the antenna structure can be sufficiently simplified. Other constituent elements and their functions are the same as those in the embodiment of FIGS. 1 and 2, and the same elements as those in the embodiment of FIGS. 1 and 2 are denoted by the same reference numerals as those used in FIGS. 1 and 2 but as added by 60.

Figure 8:
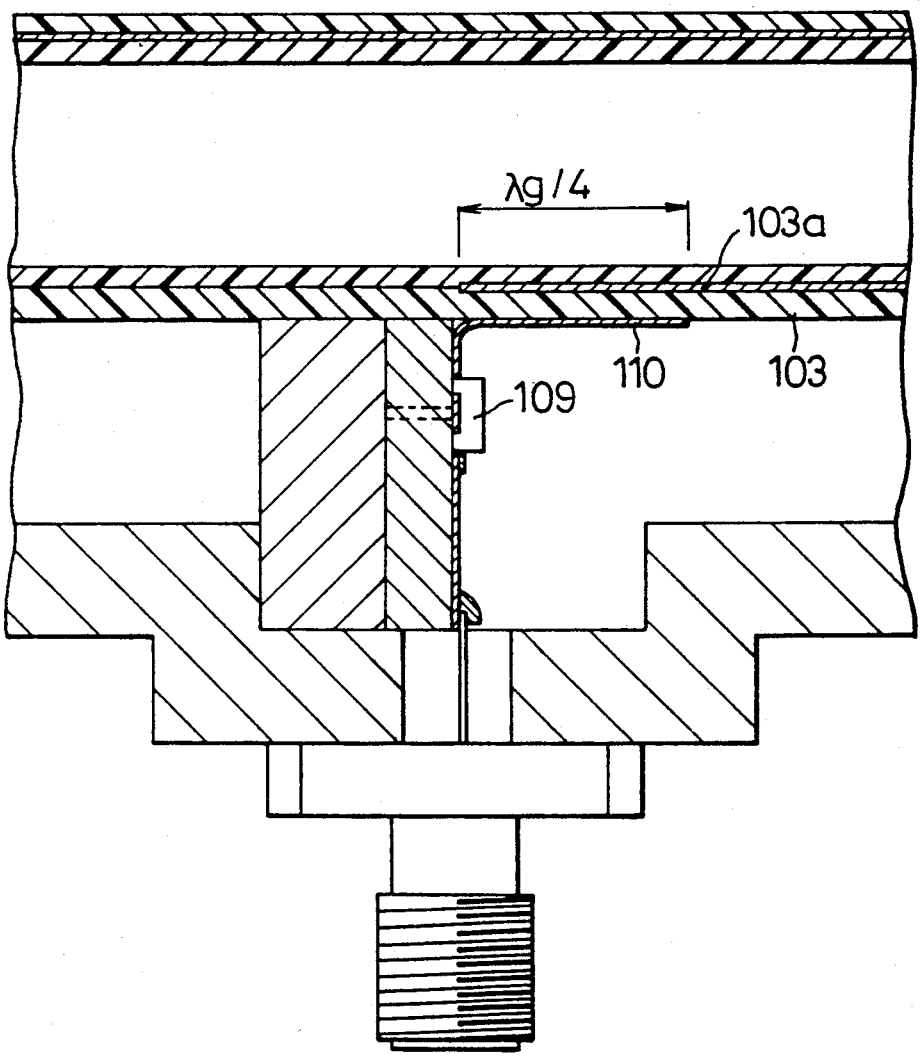
FIG. 8 is a fragmentary sectioned view, as magnified, of the planar antenna in yet another embodiment according to the present invention.
Figure 9:
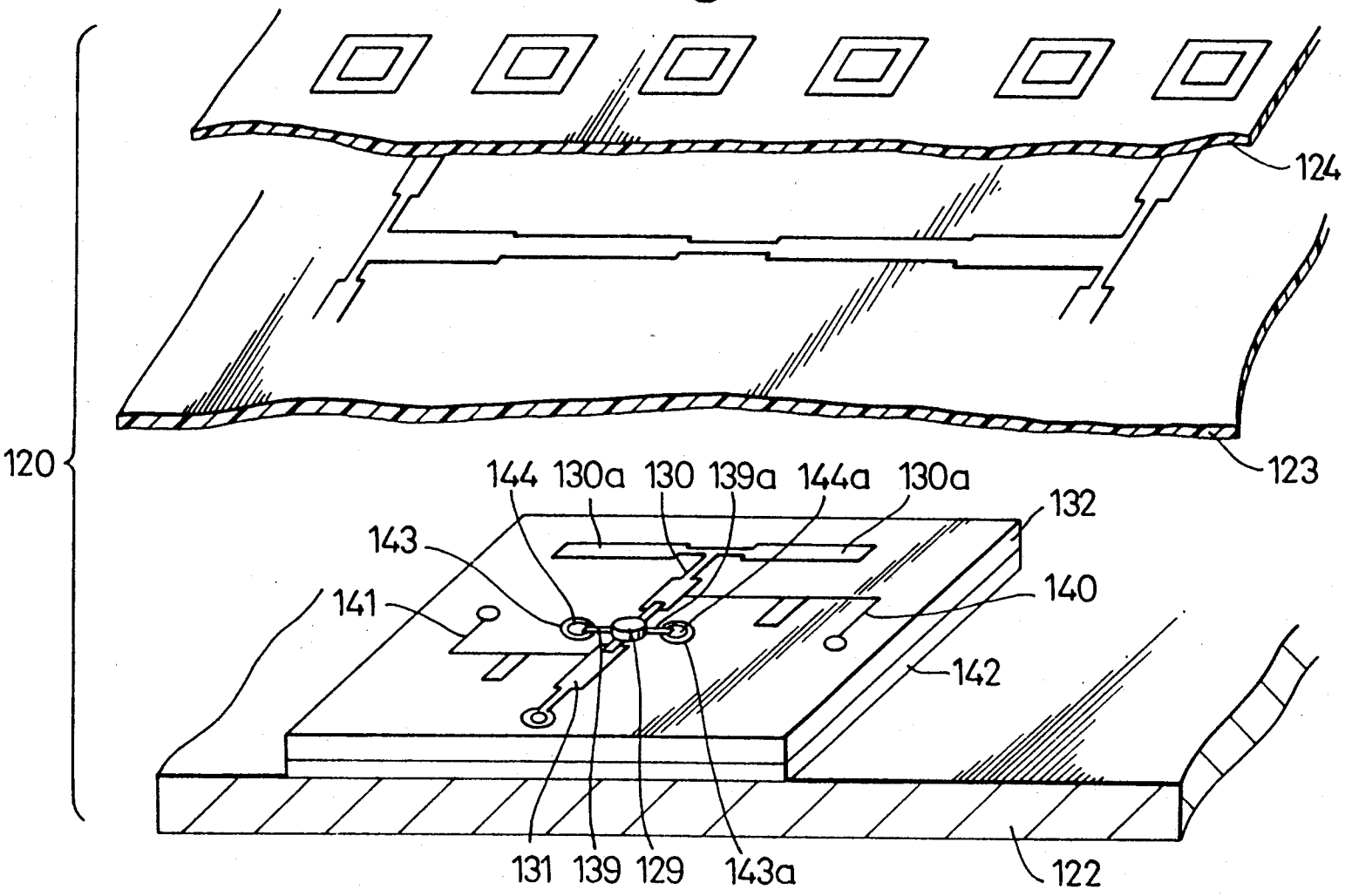
FIG. 9 is a fragmentary perspective view, as magnified, of the planar antenna in a further embodiment according to the present invention.

In yet another working aspect of the present invention as shown in FIG. 8, gate 110 of amplifying device 109 is disposed to be in parallel to conductor strip of feeding point 103*a* of feeding network plate 103 in the same manner as in the foregoing aspect of FIG. 5, for the electrostatic induction connection between them. In this event, it is preferable that the length over which the strip of the feeding point 103*a* and the gate 110 oppose in parallel relationship is set to be substantially $\lambda g/4$ (this is also applicable to the aspect of FIG. 5). Other constituent elements and their functions are the same as those in the embodiment of FIGS. 6 and 7.

In a further embodiment of the present invention as shown in FIGS. 9 through 12, auxiliary printed substrate 132 onto which amplifying device 129 is mounted is to be disposed between grounding conductor plate 122 and feeding network plate 123 with a regulating insulation sheet 142 interposed as occasion demands for regulating the height of the substrate 132. The amplifying device 129 should preferably be disposed in an aperture 123*c* made in the feeding network plate 123 and its source 139 and 139*a* are connected as soldered to connecting projections 144 and 144*a* provided to the grounding conductor plate 122 by contracting the plate so as to project upward and disposed in apertures 143 and 143*a* made through the auxiliary printed substrate 132 and insulation sheet 142. In this case, gate 130 of the amplifying device 129 is connected at its extensions 130*a* by means of the electrostatic induction to the power supply ends of the feeding network plate 123, substantially with the same arrangement as in the foregoing aspects of FIGS. 5 and 8, and drain 131 is connected to output line in the same manner as in the foregoing embodiments. In addition, a penetrating capacitor 145 is mounted as passed at forward end part through the grounding conductor plate 122, auxiliary printed substrate 132 and insulating sheet 142 for applying a biasing voltage to source 139 and 139*a* of the amplifying device 129. Other constituent elements and their functions are the same as those in the foregoing embodiments of FIGS. 1 and 2 and of FIGS. 6 and 7, and the same elements as those in FIGS. 6 and 7 are depicted by the same reference numerals as those therein used but as added by 50.

Figure 10:
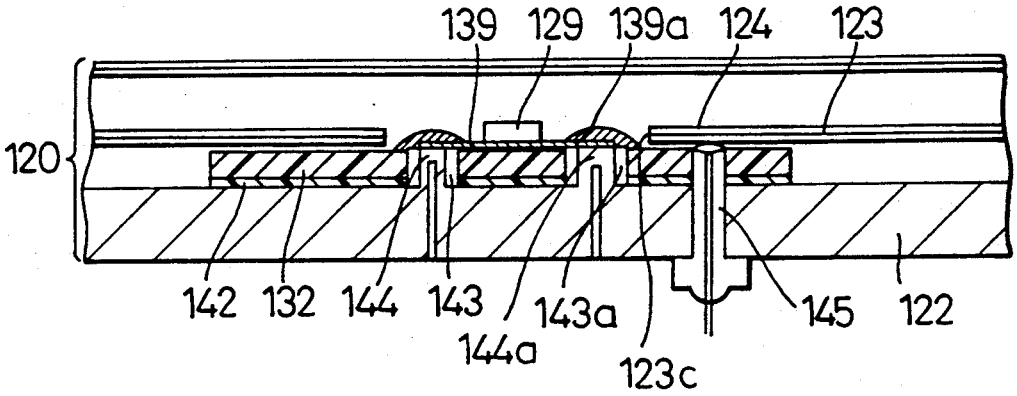
FIG. 10 is a fragmentary sectioned view of a part of the planar antenna of FIG. 9.
Figure 11:
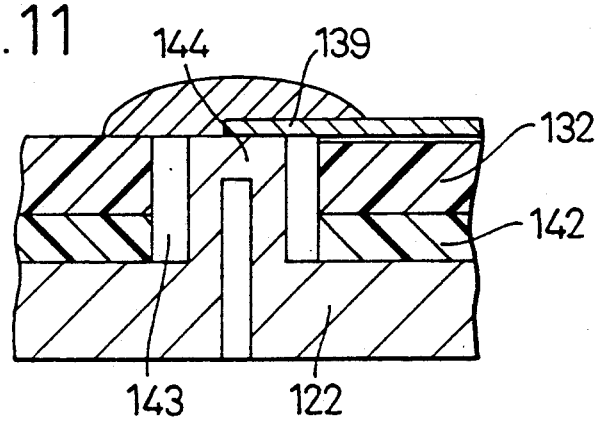
FIG. 11 is a fragmentary sectioned view, as further magnified, of a part of the planar antenna of FIG. 9.
Figure 12:
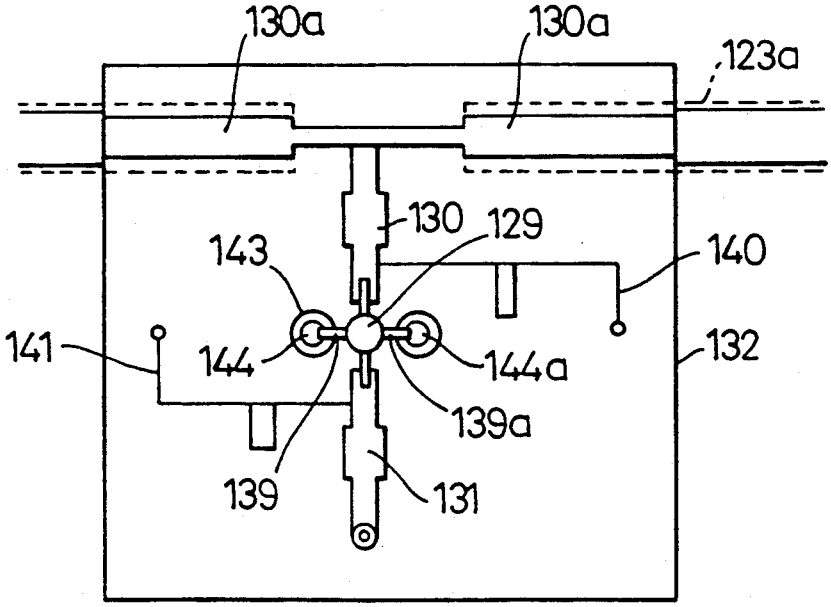
FIG. 12 shows in a plan view a part of the planar antenna of FIG. 9.
Figure 13:
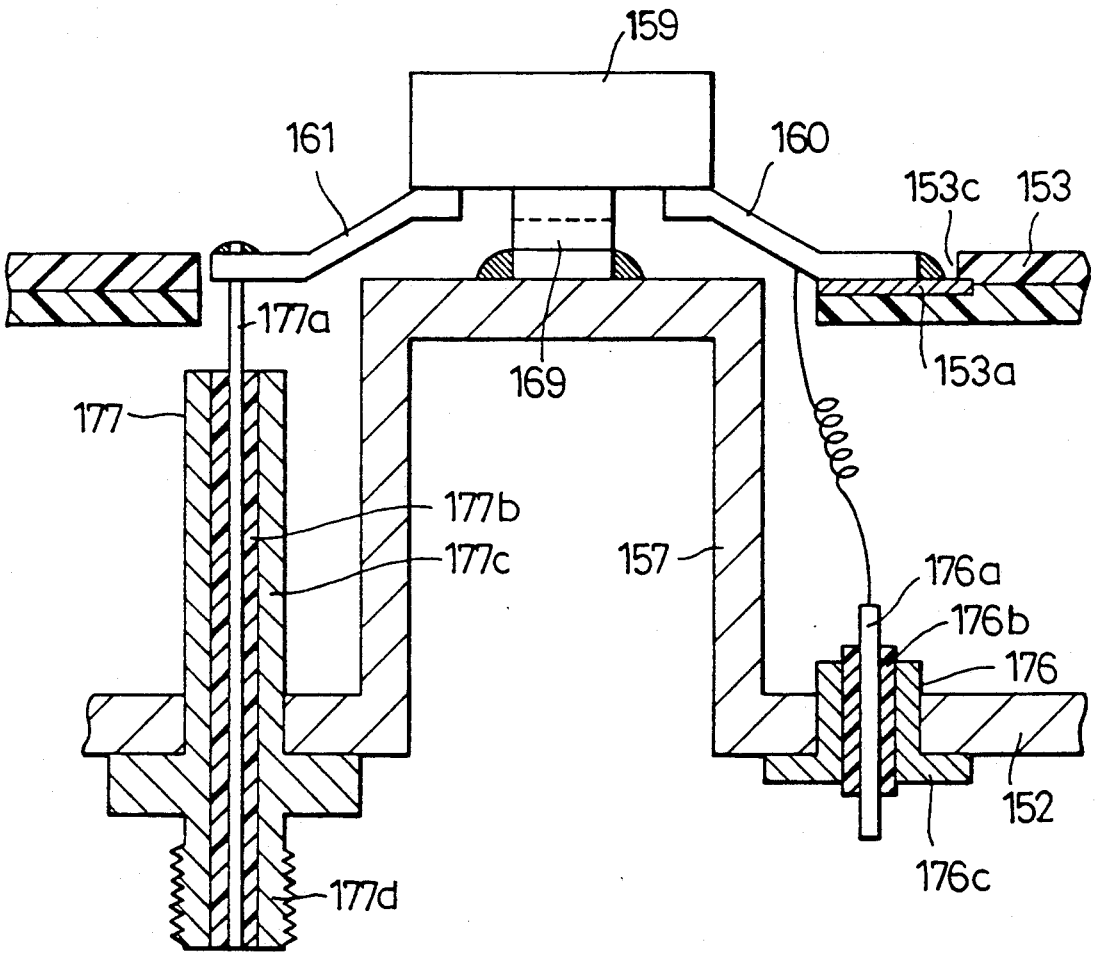
FIG. 13 is a fragmentary sectioned view, as magnified, of the planar antenna in a further embodiment according to the present invention.
Figure 14:
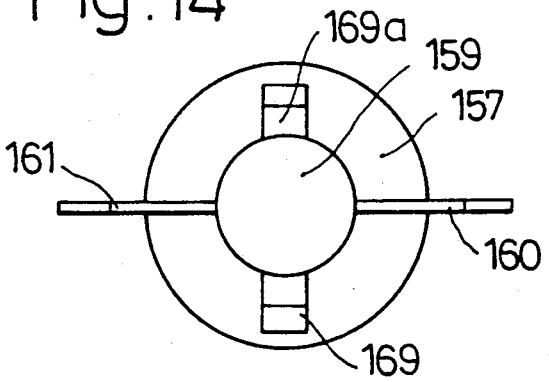
FIG. 14 shows in a plan view a part of the planar antenna of FIG. 13.
Figure 15:
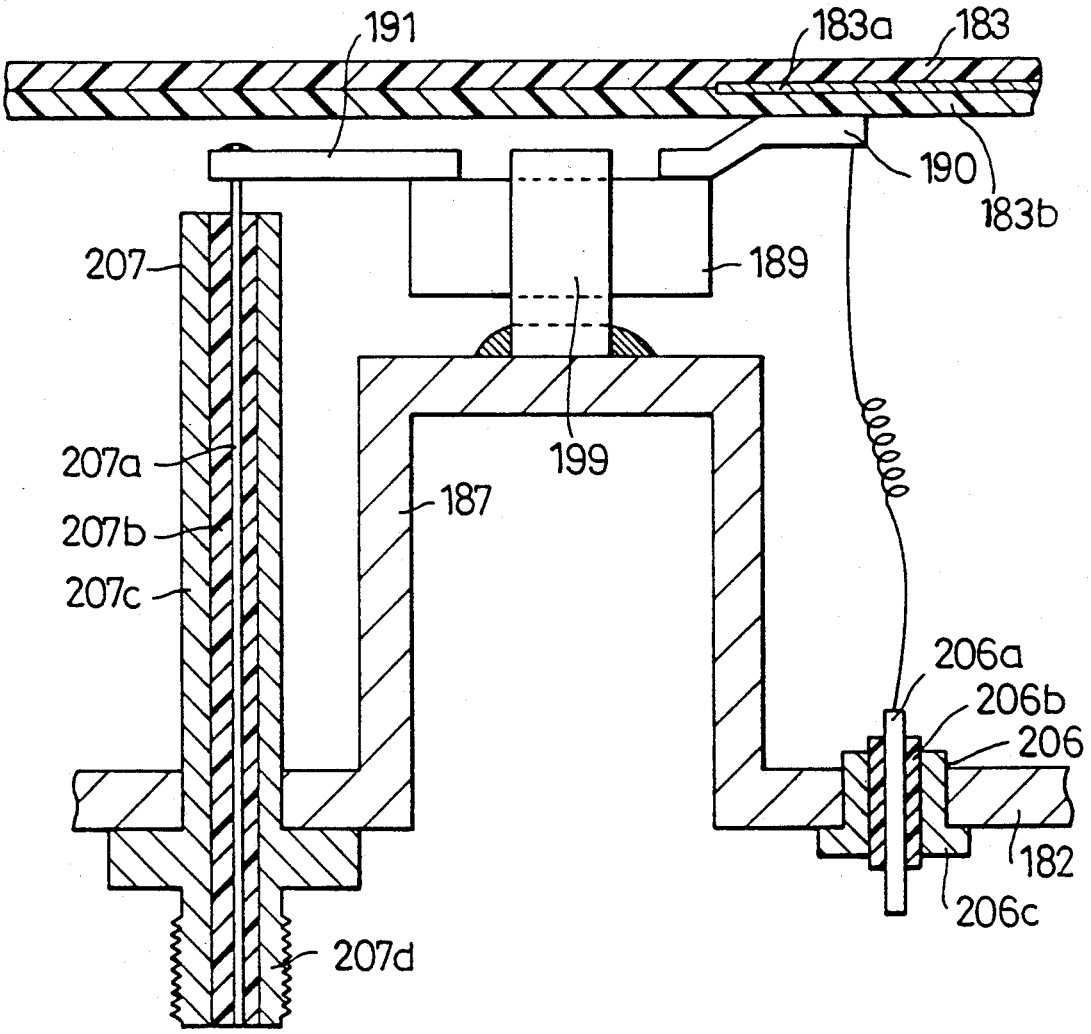
FIG. 15 is a fragmentary sectioned view, as magnified, of the planar antenna in a further embodiment according to the present invention.
Figure 16:
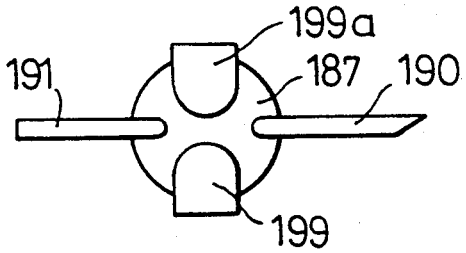
FIG. 16 is a plan view of a part of the planar antenna of FIG. 15.
Figure 17:
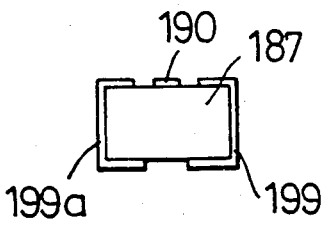
FIGS. 17 and 18 are side elevations as seen respectively on different side of the part shown in FIG. 16 of the planar antenna of FIG. 15.
Figure 18:
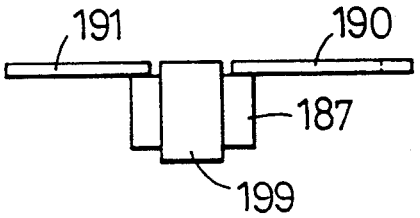

In a still further embodiment shown in FIGS. 13 and 14 of the present invention, such structure as in the embodiment of FIGS. 10 to 12 is employed, and thus a feeding network plate 153 is provided with an aperture 153*c*, while a support projection 157 to which amplifying device 159 is secured is provided in grounding conductor plate 152 by means of a pressure molding or the like so as to bulge upward. Gate terminal 160 of the amplifying device 159 is connected as soldered to a power supply terminal 153*a* of the feeding network plate 153. To this gate 160 and a drain 161 of the amplifying device 159, core conductors 176*a* and 177*a* of penetrating capacitors 176 and 177 respectively for the gate and drain are connected. In these penetrating capacitors 176 and 177, the core conductors 176*a* and 177*a* are enclosed in cylindrical insulators 176*b* and 177*b* which in turn are inserted in outer tubular conductors 176*c* and 177*c* mounted through the grounding conductor plate 152, so that a negative biasing voltage will be applied from the penetrating capacitor 176 to the gate 160 and a positive biasing voltage will be applied from the penetrating capacitor 177 to the drain 161. In this case, further, a connector base 177*d* of the penetrating capacitor 177 for the drain can be coupled to the down-converter as the active circuit block (not shown in FIGS. 13 and 14) in any known manner. Other constituent elements and their functions are the same as those in the embodiment of FIGS. 9–12 as well as the embodiments of FIGS. 1 and 2 and FIGS. 6 and 7, and the same elements as those in FIGS. 9–12 are denoted by the same reference numerals as those therein used but as added by 30.

Figure 19:
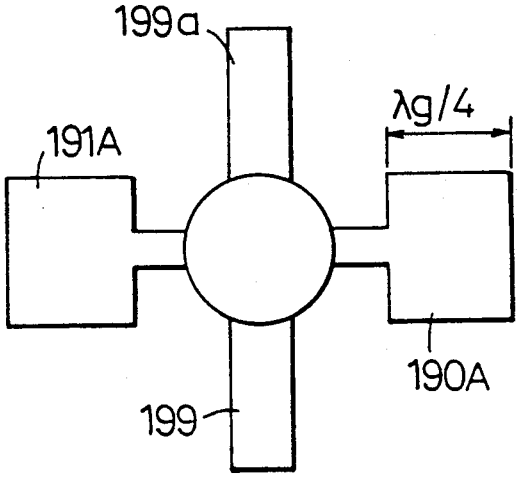
FIG. 19 shows in plan view the planar antenna in another working aspect according to the present invention.

In a yet further embodiment shown in FIGS. 15 to 18, gate 190 of amplifying device 189 is not connected directly as soldered to feeding point 183*a* of power circuit plate 183, but amplifying device 189 is disposed to oppose the feeding network plate 183 so as to dispose gate 190 in parallel to feeding point 183*a* of the feeding network plate 183 with insulating sheet 183*b* of the plate 183 interposed between them and to thereby couple the point 183*a* to the gate 190 through the electrostatic induction. Further in this arrangement, it will be possible to achieve an impedance matching by forming the gate and, if required, the drain of the amplifying device into such square shaped gate and drain 190A and 191A as shown in FIG. 19, the square shape having preferably a side length of $\lambda g/4$. Other constituent elements and their functions are the same as those in the foregoing embodiments including the one of FIGS. 13 and 14, and the same elements as those in FIGS. 13 and 14 are denoted by the same reference numerals but as added by 30.

Figure 21:
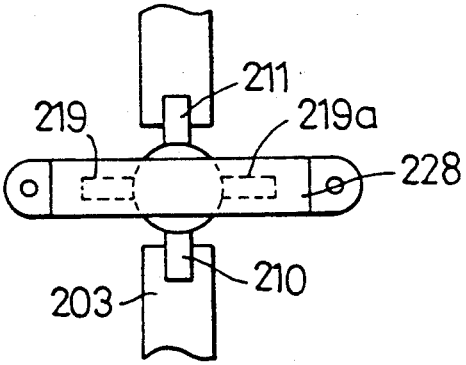
FIG. 21 is a partial plan view of a part of the planar antenna of FIG. 20.
Figure 20:
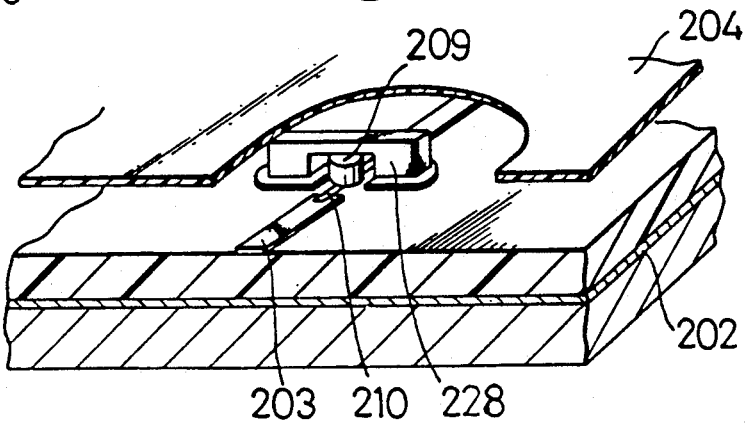
FIG. 20 is a fragmentary perspective view, as magnified, of the planar antenna in a further embodiment according to the present invention.
Figure 22:
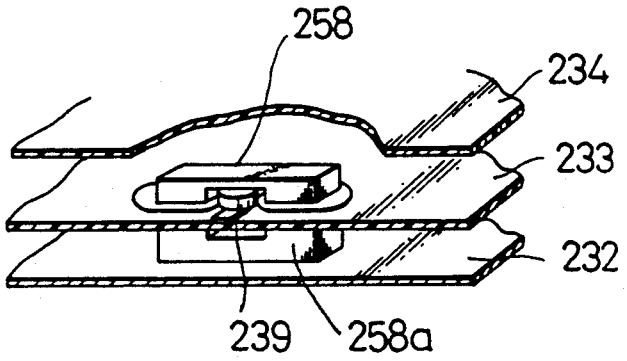
FIG. 22 is a fragmentary perspective view of the planar antenna in still another embodiment according to the present invention.
Figure 23:
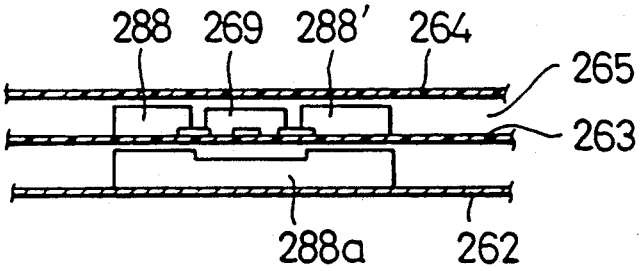
FIG. 23 shows in a fragmentary sectioned view of the planar antenna in yet another embodiment according to the present invention.

In a further embodiment shown in FIGS. 20 and 21, a shield member 228 is provided to cover amplifying device 209 connected at its gate 210 to power supply terminal of feeding network plate 203. In this case, source 219 and 219*a* of amplifying device 209 extend in a direction perpendicular to the gate 210 and to a drain 211 aligned with the gate 210, and the shield member 228 is disposed to be in the same direction as such extending direction of the source 219 and 219*a*, whereby a radiation occurring adjacent the drain 211 of the amplifying device 209 on the feeding network plate 203 can be effectively prevented from reaching the gate 210. Further, as shown in FIG. 22, it will be possible to provide a pair of shield members 258 and 258*a* to be above and below amplifying device 239, that is, on front and rear surfaces of feeding network plate 233 disposed between grounding conductor plate 232 and radiation circuit plate 234, for improving the action of preventing the radiation from reaching the gate. In an event where, as shown in FIG. 23, feeding network plate 263 and radiation circuit plate 264 oppose each other with a relatively small space 265, the shield member covering the amplifying device may be formed in such that a bridging portion across the device 269 of the shield member is omitted so that both side divided parts 288 and 288' of the shield member only will be disposed on both sides of the device 269 on the front side of the circuit plate 263, and the radiation can still be prevented from reaching the gate. Such shield member as shown in FIGS. 20 to 23 may also be employed effectively in the respective embodiments of FIGS. 1 through 19.

What is claimed is:

1. A planar antenna comprising an antenna body into which a grounding conductor plate, a feeding network plate having a feeding network pattern formed thereon and a radiation circuit plate having a radiation circuit pattern formed thereon are assembled as mutually separated, an active circuit block mounted to said antenna body incorporating therein active circuit elements, and means for connecting a feeding point of said feeding network plate to a connecting point of said active circuit block, wherein said grounding conductor plate is provided with an aperture at a portion corresponding to said feeding point of said feeding network plate, said active circuit block comprising a down-converter which includes a casing having a projection insertable into said antenna body through said aperture, said casing accommodating therein said active circuit elements, said projection carrying on an end wall a low noise amplifying device with an input terminal of said amplifying device exposed, and said feeding point of said feeding network plate being connectable to said input terminal of said amplifying device upon insertion of the projection into said antenna body.

2. The planar antenna of claim 1 wherein said antenna body is provided with a shield member for separating said input terminal from an output terminal of said amplifying device.

3. A planar antenna comprising an antenna body into which a grounding conductor plate, a feeding network plate having a feeding network pattern formed thereon and a radiation circuit plate having a radiation circuit pattern formed thereon are assembled as mutually separated, an active circuit block mounted to said antenna body incorporating therein active circuit elements, and means for connecting a feeding point of said feeding network plate to a connecting point of said active circuit block, wherein said active circuit block comprises a down-converter, said antenna body further includes an auxiliary grounding conductor and an auxiliary printed substrate supported by said auxiliary grounding conductor and disposed between said grounding conductor plate and said feeding network plate; said auxiliary printed substrate carrying an low noise amplifying device; said amplifying device having an input terminal connected to said feeding point of said feeding network plate, a grounding terminal connected to said auxiliary grounding conductor and an output terminal connected to said down-converter of said active circuit block.

4. The planar antenna of claim 3 wherein said antenna body includes a shield member for preventing a radiation occurring adjacent said output terminal of said amplifying device from reaching said input terminal

5. A planar antenna comprising an antenna body into which a grounding conductor plate, a feeding network plate having a feeding network pattern formed thereon and a radiation circuit plate having a radiation circuit pattern formed thereon are assembled as mutually separated, an active circuit block mounted to said antenna body incorporating therein active circuit elements, and means for connecting a feeding point of said feeding network plate to a connecting point of said active circuit block, wherein said active circuit block comprises a down-converter, and said antenna body further includes an auxiliary printed substrate disposed between said grounding conductor plate and said feeding network plate to be in parallel with the feeding network plate, and a low noise amplifying device disposed on said auxiliary printed substrate on the side of said feeding network plate, said auxiliary printed substrate having an aperture, said grounding conductor plate having a connecting projecting projected out of the grounding conductor plate and disposed in said aperture of the auxiliary printed substrate, and said amplifying device being connected at an input terminal to said feeding point of the feeding network plate, at a grounding terminal to said connecting projection of the grounding conductor plate and disposed in said aperture, and at an output terminal to said down-converter of said active circuit block.

6. The planar antenna of claim 5 wherein said antenna body includes a shield member for preventing a radiation occurring adjacent said output terminal of said amplifying device from reaching said input terminal.

7. The planar antenna of claim 5 wherein said feeding network plate has an aperture, and said amplifying device is disposed in said aperture of the feeding network plate.

8. A planar antenna comprising an antenna body into which a grounding conductor plate, a feeding network plate having a feeding network pattern formed therein and a radiation circuit plate having a radiation circuit pattern formed thereon are assembled as mutually separated, an active circuit block mounted to said antenna body incorporating therein active circuit elements, and means for connecting a feeding point of said feeding network plate to a connecting point of said active circuit block, wherein said active circuit block comprises a down-converter, and said antenna body further includes a low noise amplifying device, said feeding network plate having an aperture, said grounding conductor plate having a support projection opposing said aperture of the feeding network plate, said amplifying device being secured to said supporting projection of the grounding conductor plate and disposed in said aperture of the feeding network plate, and said amplifying device being connected at an input terminal to said feeding point of the feeding network plate, at a grounding terminal to the grounding conductor plate and at an output terminal to said down-converter of said active circuit block.

9. The planar antenna of claim 8 wherein said antenna body includes a shield member for preventing a radiation occurring adjacent said output terminal of said amplifying device from reaching said input terminal.

* * * * *